US007540119B2

(12) United States Patent
Milburn

(10) Patent No.: US 7,540,119 B2
(45) Date of Patent: Jun. 2, 2009

(54) POINT-SUPPORTED GLAZED CLADDING SYSTEM

(75) Inventor: Doug Milburn, Nova Scotia (CA)

(73) Assignee: Advanced Glazing Technologies Limited (AGTL), Sydney, NS (CA)

( * ) Notice: Subject to any disclaimer, the term of this patent is extended or adjusted under 35 U.S.C. 154(b) by 332 days.

(21) Appl. No.: 10/855,306

(22) Filed: May 27, 2004

(65) Prior Publication Data

US 2005/0262783 A1 Dec. 1, 2005

(51) Int. Cl.
*E04B 2/32* (2006.01)
*E04B 2/46* (2006.01)

(52) U.S. Cl. ..... 52/235; 52/489.1; 52/506.05; 52/511

(58) Field of Classification Search ..... 52/508, 52/509, 511, 475.1, 489.1, 235, 506.05
See application file for complete search history.

(56) References Cited

U.S. PATENT DOCUMENTS

| | | | | |
|---|---|---|---|---|
| 2,490,663 | A * | 12/1949 | Van Uum et al. | 52/460 |
| 4,198,796 | A * | 4/1980 | Foster | 52/203 |
| 4,817,352 | A * | 4/1989 | DeLange et al. | 52/235 |
| 4,837,996 | A * | 6/1989 | Eckelt | 52/235 |
| 5,184,440 | A * | 2/1993 | Felix et al. | 52/235 |
| 5,369,924 | A | 12/1994 | Neudorf et al. | |
| 5,522,193 | A * | 6/1996 | Sommerstein et al. | 52/235 |
| 2003/0208975 | A1 * | 11/2003 | Regina | 52/306 |

(Continued)

FOREIGN PATENT DOCUMENTS

| | | | |
|---|---|---|---|
| DE | 3128246 | * | 2/1983 |

(Continued)

OTHER PUBLICATIONS

Oldcastle Glass; "Structural Glass Systems"; Specification Document; 2004; Section 13-03, pp. 1-29; Santa Monica; United States.

(Continued)

*Primary Examiner*—Robert J Canfield
*Assistant Examiner*—Christine T Cajilig
(74) *Attorney, Agent, or Firm*—Lawrence E. Laubscher, Jr.

(57) ABSTRACT

A point-supported cladding system for finishing the exterior of a building or like structure has a plurality of like rigid box-like glazed cladding units. Each cladding unit includes a rigid spacer frame bounding the cladding unit, a pair of parallel light-transmissive glass lites having a thickness of not more than about 9 mm mounted at their periphery on said rigid spacer frame by means of a resilient seal, and a plurality of first attachment elements provided at discrete attachment points on said cladding unit. The cladding unit is dimensioned and configured to have sufficient rigidity to maintain its structural integrity when supported only at the discrete attachment points. A plurality of complementary second attachment elements are provided for mounting on structural members of the building. The complementary attachment elements co-operate and are engagable with the respective first attachment elements to retain the cladding units in a contiguous array on the building and thereby provide an exterior wall of the building. The co-operating first and second attachment elements bear the load of the cladding units and lock the cladding units against movement in a direction normal to the wall while permitting limited freedom of movement of the cladding units relative to each other and the building in a plane parallel to said wall.

14 Claims, 5 Drawing Sheets

FOREIGN PATENT DOCUMENTS

| | | | | |
|---|---|---|---|---|
| DE | 3612681 | A1 | | 7/1987 |
| DE | 4333522 | A1 | | 4/1995 |
| DE | 20304865 | U1 | | 6/2003 |
| DE | 20304865 | U1 | * | 7/2003 |
| WO | 0121906 | A1 | | 3/2001 |
| WO | WO 02/35046 | A2 | * | 10/2001 |
| WO | 0235046 | A | | 5/2002 |

OTHER PUBLICATIONS

W&E Glass, LLC; "Pilkington Planar, The World's Leading Structural Glass System"; Specification Document; 2003/2004; pp. 1-20; Nanuet; United States.

* cited by examiner

POINT-SUPPORTED GLAZED CLADDING SYSTEM

FIELD OF INVENTION

This invention relates to the field of cladding systems for buildings and similar structures, such as free-standing walls or signs, and more particularly it relates to a glazed cladding system employing panes or lites of glass.

BACKGROUND OF THE INVENTION

Glass is, in many respects, an ideal cladding material for buildings. It has an aesthetically pleasing look that is extremely durable compared to other materials, and it is maintenance free except for occasional cleaning. In its natural state, it is clear and may be tinted or coated to control appearance. It may be made fully transparent to provide a view and admit direct sunlight, or it may be made translucent or opaque via etching or coating. In the latter case it will admit diffuse light, which provides a far superior quality of natural light and helps avoid glare and localized overheating characteristic of direct beam sunlight.

The most common form for glass as building material is in flat sheets, produced by the float process. Such flat glass is either used in its monolithic form, or fabricated into "insulating glass units" characterized by two or more glass panes, known as lites, each lite being separated by a spacer around the perimeter. The most common range of thicknesses for lites of glass is 3 mm to 6 mm (⅛" to ¼"). Typically, the airspace in an insulating glass unit is on the order of 12.5 mm (0.5"). The spacer does not provide structural rigidity and such glass units have to be attached to the building by a framing system that extends around the glass unit.

Despite all its good qualities, flat glass can be challenging to use in building situations because it is relatively brittle and low in strength. It can be easily broken by application of stress. As a result, in typical applications, glass must be supported around its entire perimeter by a framing system. The framing system must support the glass uniformly, such that any force applied to the glass in reaction to wind load (or, in the case of sloped glass, dead load) is distributed as possible over the perimeter. The edge of the glass must be clamped in a manner that is free from angular constraint around an axis parallel with the perimeter in order to prevent stress concentration.

These stringent requirements are generally met by the use of window framing and curtainwall framing. These framing systems hold the glass at the perimeter without angular constraint of edges, either by clamping the glass between elastomer seals, or by use of a structural elastomer adhesive, typically silicone. The framing system, which is fixed to the building, must be made from linear elements that are straight and true, and these elements must be assembled so that they are in a common plane, in order that the supporting surface for the glass be flat at the time of installation. The linear elements that make up the framing system must also be substantial (that is, have sufficient moment of interia), in order to remain flat under load (typical specification for maximum deflection under windload is length/175). Therefore, the framing system must be carefully manufactured from elements that have significant structural value, especially in larger-sized window and glazing systems.

Although the use of flat glass in window and curtainwall systems is commonplace, highly evolved and reliable, the need for framing and specialized glazing techniques contributes greatly to the price. It is not uncommon for the cost of the glass to represent 25% or less of the installed cost of the cladding system. The other 75% or more of the installed cost is for framing and installation cost; or in other words, framing and installation can represent more than three times the cost of the glass itself. As a result, the cost per unit area to clad openings or sections of buildings with conventional glass systems can greatly exceed the cost per unit area to clad the same opening with opaque claddings, which by their nature are not subject to the stringent stress management requirements that apply to glass. Often the price differential between conventional glass claddings and opaque claddings is two times or more.

Cost premiums that result from framing requirements imposed by the lack of inherent structural strength influences the entire field of architecture and construction. Budget considerations often forces building designers to use opaque materials where glass may have been desirable. This may occur either at design stage or during rounds of 'value engineering' necessary to trim costs when building designs exceed budgets. This is particularly relevant in buildings where lowest capital cost is a dominant criterion, such as industrial buildings or publicly funded schools. As a result, many building occupants do not receive the benefits of view and natural light that can be obtained through the appropriate use of glass in building designs.

Frameless 'point-supported' glass systems are available in today's marketplace. They hold glass via metal attachments called spiders, which are either fixed through holes drilled through the corners of the glass, or by high-performance adhesives. These systems rely on the glass itself to provide the rigidity necessary to work with point support systems. The goal of these systems is usually to achieve an elegant, highly transparent aesthetic, and they are not intended as a cost-effective clad over structure system. Because point-support systems do not support glass around the perimeter, they require increased glass thickness, compared to the glass thickness required by window and curtainwall systems which support the glass around the perimeter. Such "thick" glass typically has a thickness of 9 mm or more.

There are numerous opaque panel systems in use worldwide in the construction industry for building cladding. Common panels include metal-clad foam, metal-clad honeycomb, concrete, and stone. Opaque panels are designed to have sufficient structural strength to resist windload and other loads that may be applied to them. Depending on the system, panels are attached to buildings by a number of methods, such as framing similar to that used for glass systems (many panels can be glazed directly into curtainwall frames), or various clip systems including hook and pin.

There are a number of light-admitting plastic panel systems. For example, CPI daylighting (www.cpidaylighting.com) uses multi-wall polycarbonate sheets that have inherent structural capacity sufficient to bear wind load and dead load over the scale of a single panel. The material is relatively low modulus, and therefore sheets have sufficient flexibility to avoid stress concentration when clipped to structural members. Sheets may be semi-transparent, translucent, or opaque. Internal structure precludes total transparency. Kalwall (www.kalwall.com) is translucent panel system, based on panels comprising two sheets of thin (1.5 mm) fibre reinforced plastic, bonded to an aluminum 1 beam lattice structure of approximately 2.5" thickness and in plane lattice dimensions of approximately 30 cm (1')×60 cm (2'). Kalwall panels are held in place by framing and inter-panel clamps.

SUMMARY OF THE INVENTION

The present invention provides a method to construct a glass-based panel using thin glass panes, such that the panel has inherent structural properties sufficient to bear loads from panel weight, wind, snow etc, and transfer those loads to a structure via a clip system that is used to attach the panels directly to structural members. Besides allowing rapid installation without the need for framing, this system maintains the position of the glass panel under load in a way that allows movement due to differential thermal expansion, load-induced deflection, and settling of structure, without imposing excessive concentrations of stress that could break the glass.

According to the present invention there is provided a point-supported cladding system for finishing the exterior of a building or like structure, comprising a plurality of like rigid box-like glazed cladding units; each cladding unit comprising: a rigid spacer frame bounding said cladding unit; a pair of parallel light-transmissive glass lites having a thickness of not more than about 9 mm mounted at their periphery on said rigid spacer frame by means of a resilient seal; a plurality of first attachment elements provided at discrete attachment points on said cladding unit; and said cladding unit being dimensioned and configured to have sufficient rigidity to maintain its structural integrity when supported only at said discrete attachment points; a plurality of complementary second attachment elements for mounting on structural members of said building, said complementary attachment elements co-operating and being engagable with said respective first attachment elements to retain said cladding units in a contiguous array on said building and thereby provide an exterior wall of said building, said co-operating first and second attachment elements bearing the load of said cladding units and locking said cladding units against movement in a direction normal to said wall while permitting limited freedom of movement of said cladding units relative to each other and said building in a plane parallel to said wall.

In this specification it is understood that the expression "point-supported" means that the cladding system is supported at discrete locations or points around its periphery as distinct from in a frame-like manner where a where member extends over a significant length along its periphery providing virtually continuous support. The invention is not restricted to buildings. It can be used with similar structures, such as free-standing walls or signs. The "Toyota portal" would be one example of such a sign.

In a preferred embodiment a weathertight finishing material is inserted in the interstices between adjacent said cladding units of said contiguous array. It is also possible to provide a rainscreen as to be more particularly described.

Cladding systems in accordance with the invention, while using conventional thin glass, i.e. glass having a thickness of generally less than about 9 mm, and typically 3-6 mm, do not employ conventional window or curtainwall framing attached to the building structure. They are thus "frameless" in the sense that no frame is required on the building. They are therefore efficient and simple to install.

The spacer frame within the cladding units is preferably made of aluminum, steel, or fiber glass, and itself has sufficient rigidity to impart structural integrity to the complete unit. One difficulty experienced in making such units with thin glass, which is inherently weak, is that any bond between the glass and the spacer frame must allow for thermal expansion of the glass yet at the same time provide a sufficiently effective bond for the entire unit to display structural integrity. It has been found that this can be achieved by bonding the glass lites at their periphery to the spacer frame with a resilient sealant, such as glazing silicone. A suitable glazing silicone, for example, is made by Dow Corning Corporation.

Embodiments of the invention provide a way to clad buildings with glass directly over structural members, trusses, or space frame support points without the need for conventional framing, thereby reducing material requirements and installed system cost.

The invention provides a way to effectively install glass-cladding units by simply hanging panels via attachment clips. This allows a reduction in overall installation labour, versus the need to first install framing, then to lay in glass, and finally to secure the glass via pressure caps, glazing stops, or structural adhesive.

The invention provides a way to utilize glass in combination with structural members that are subject to relatively large deflections, for example greater than L/175.

BRIEF DESCRIPTION OF THE DRAWINGS

The invention will now be described in more detail, by way of example only, with reference to the accompanying drawings, in which:—

DETAILED DESCRIPTION OF THE PREFERRED EMBODIMENTS

Figure 1:
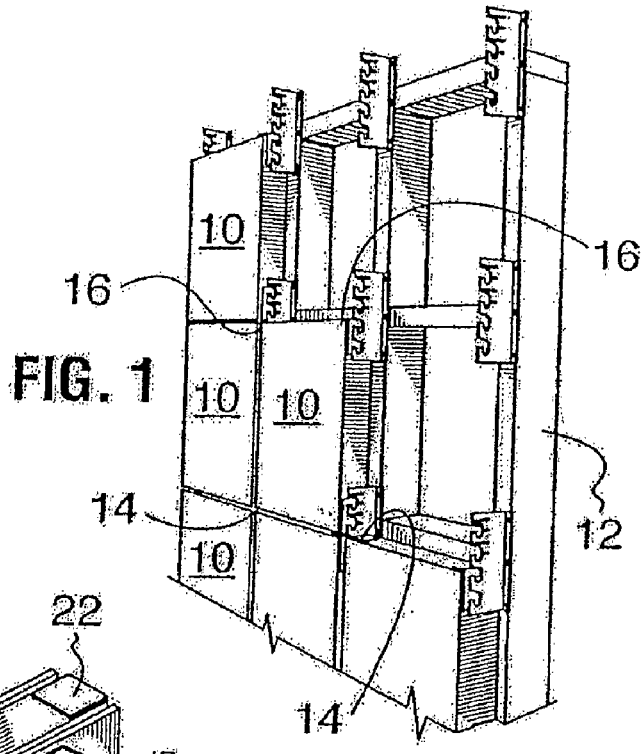
FIG. 1 shows an array of cladding units in accordance with one embodiment of the invention.

As shown in FIG. 1, the cladding system in accordance with an embodiment of the invention comprises an array of rectangular box-like glazed cladding units 10 mounted on structural support members 12, which typically form part of the frame of a building to be clad. FIG. 1 shows a demonstration system in which the cladding units 10 are mounted onto a wooden frame structure in a continuous array forming a wall.

The cladding units 10 are mounted onto the frame structure by means of a point-support attachment system to be described in more detail. Each cladding unit is supported at its corners. The lower two corners 14 support the deadweight of the cladding unit itself. The upper two corners 16 allow for upward vertical movement to accommodate thermal expansion and movement of the building itself. The attachment system also locks the cladding units against the structure in a direction normal to the plane of the wall that the cladding units are secured against windload.

Figure 2A:
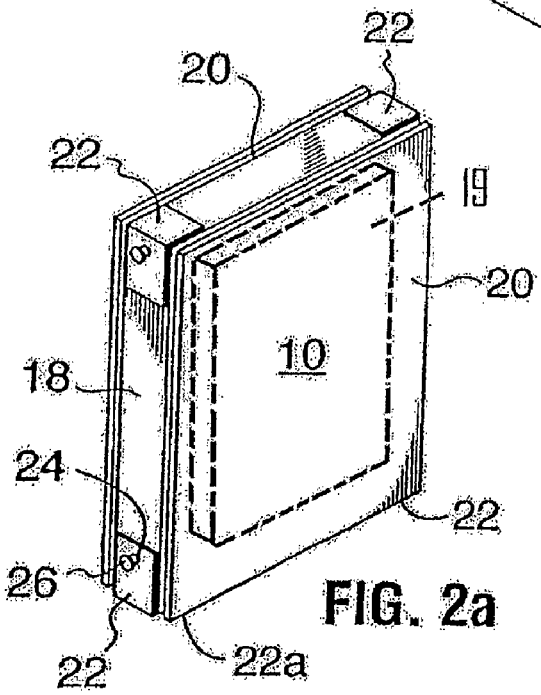
FIG. 2*a* is a perspective view of a glazing unit in accordance with one embodiment of the invention.
Figure 2B:
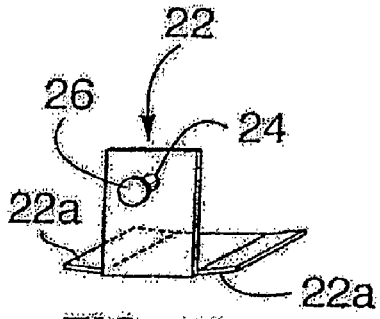
FIG. 2*b* shows a component of the glazing unit.

As shown in FIG. 2, the glazed cladding unit in accordance with an embodiment of the invention comprises a pair of glass panes or lites separated by a rectangular aluminum spacer frame 18 defining a box-like structure. Glass panes or "lites" 20 having a thickness of less than 9 mm, and preferably between 3 and 6 mm, are attached at their periphery to the spacer frame 18 by means of commercial silicone glazing sealant. It is found that such a construction can be made highly rigid by using a sufficiently strong spacer frame, increasing the spacing of the glass lites, preferably to 2.5" for a 48"×48" spacer frame. Indeed, it is anticipated that it will be possible to make panes up to 4×8' or more, or by including a light-transmissive honeycomb insert 19 between the panes. The honeycomb insert is generally made of plastic and thus has sufficient flexibility to allow for movement of the lites.

The spacer frame provides the structural strength to the unit. The silicone sealer provides sufficient resilience to allow for the thermal expansion of the lites without compromising the rigidity and structural integrity of the unit.

Angle pieces 22 are attached to the corners of the spacer frame 18, by screws or rivets, for example. The angle pieces 22 support attachment elements in the form of protruding stainless steel load-bearing pins 24 with enlarged heads 26. The pins 24 engage in slots in corresponding attachment elements mounted on the building structure. The lower angle pieces have shelves 22*a* that extend beyond the spacer frame underneath the inner and outer lites. A block of rubber inserted between the shelves and the lites of glass acts as a setting block, transferring deadload from the weight of each lite into the angle piece and pin. In this way, long term dead loads on the silicone sealant and resultant creep of the glass relative to the spacer are avoided.

Figure 3A:
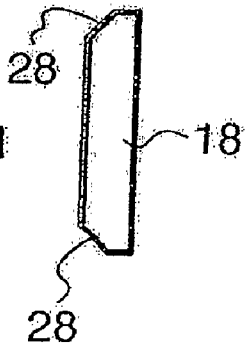
FIGS. 3*a* and 3*b* illustrate a suitable section of spacer frame.
Figure 3B:
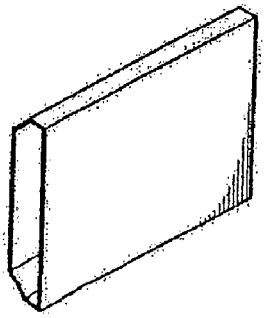

A section of the spacer frame 18 is shown in more detail in FIGS. 3*a* and 3*b*. This is made of a generally rectangular extruded hollow aluminum section having beveled edges 28 on the inside.

Structural members are required to support the wall system or roof system. Any structural member, including steel, aluminum, or wood sections or trusses, capable of bearing wind load and dead load, may be used as support for the cladding units in accordance with the invention.

Figure 4:
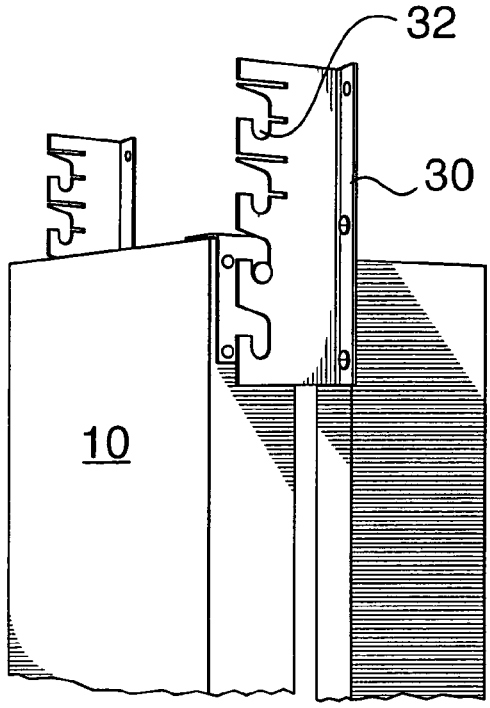
FIG. 4 illustrates a bracket for attachment to a building structure.

FIG. 4 shows the bracket 30, which is attached to the structural members of the building. The bracket includes generally elbow or L-shaped slots 32 that receive the pins 24 of the attachment elements on the cladding units.

Figure 5A:
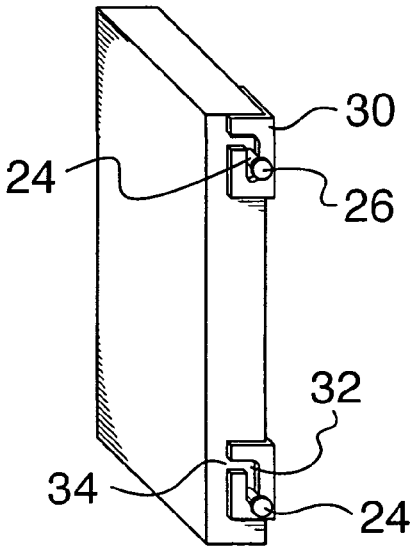
FIGS. 5*a* and 5*b* show an attachment element for the building structure.
Figure 5B:
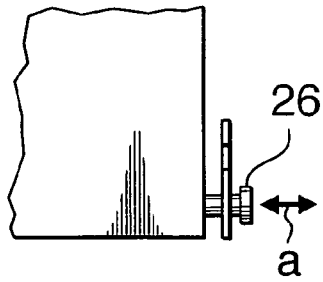

FIG. 5*a* is another view show a similar bracket 30 with slot 32. The brackets 30 are arranged in upper and lower pairs on opposite sides of the glazing unit 10. The spacing of the upper and lower pairs of brackets 30 is arranged so that the pins 24 engaging the lower pair are seated firmly in the bottom of the slots 32, whereas the pins 24 engaging the upper slots are located roughly in the middle of the slots. The pins have a diameter corresponding to the width of the vertical limbs of the slots 32. This arrangement ensures that the cladding units are locked against movement in a direction normal to their surface and hence the wall of the building. This is important for ensuring resistance to windload. The lower pair of slots 32 carries the full deadweight of the cladding unit 10. The upper pair of pins can move in the vertical direction to allow for expansion of the cladding units or movement of the building. The enlarged heads of the pins can also be located to permit lateral play in the direction of arrow a, as shown in FIG. 5*b*, so as to allow limited lateral movement of the cladding units for the same purpose.

The elbow shaped configuration of the slots allows the panels to be applied using a conventional suction cup for handling glass by simply lifting the panels and pressing them horizontally into the horizontal entrances of the slots 32 and then sliding the units downwards, allowing the pins to drop down into the vertical portions of the slots 32 to secure the cladding units in place. Installation is therefore very quick and simple to perform.

Figure 2C:
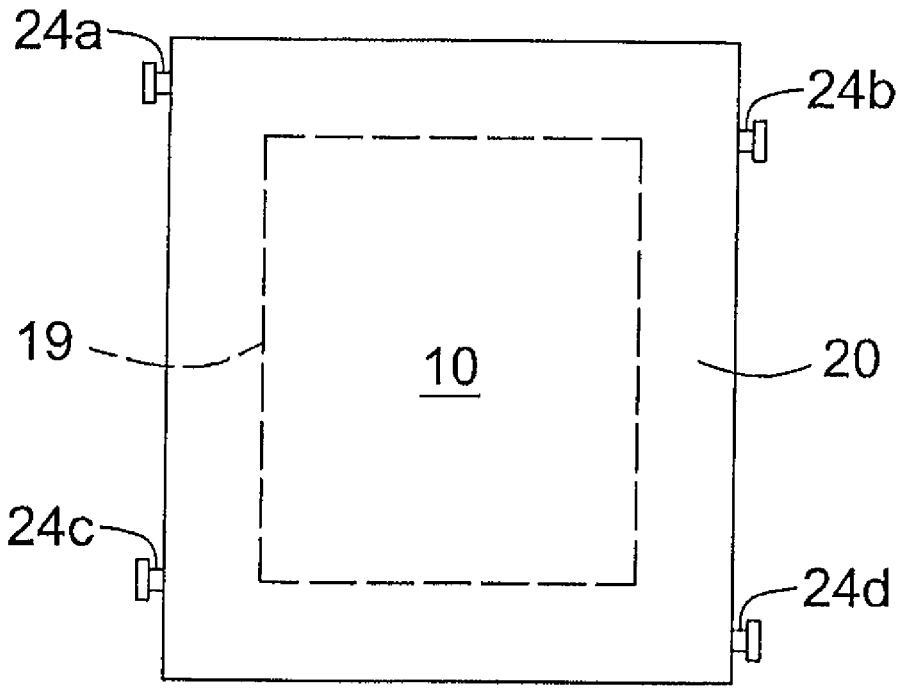
FIG. 2*c* illustrates a front view of the unit FIG. 2*b;*
Figure 6:
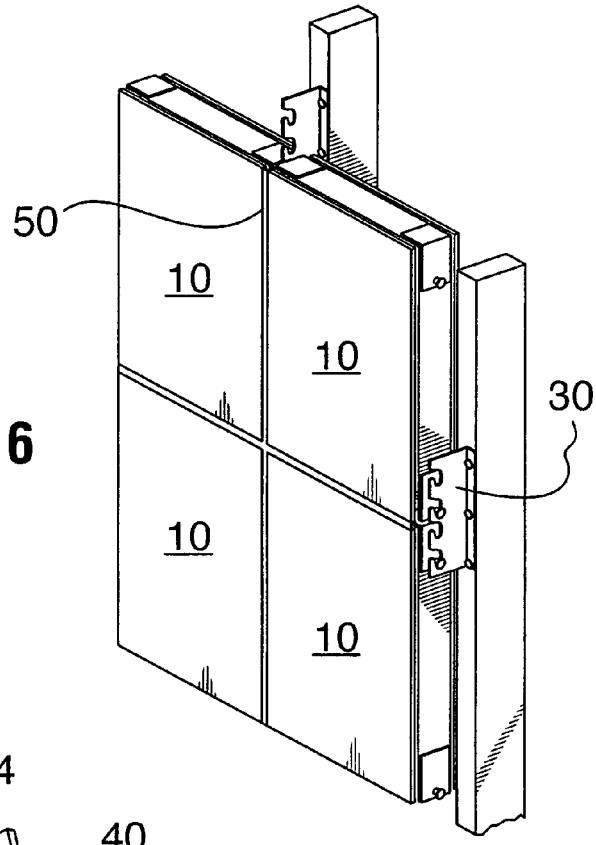
FIG. 6 is a perspective view showing four cladding units mounted to a building frame by pins and slotted brackets.

FIG. 6 shows four cladding units 10 mounted in place on a simulated building structure. Each bracket 30 has four slots lying in the same plane to accommodate pins from all adjacent upper and lower panels. As shown the bracket 30 accommodates a lower pin 24 from the upper cladding unit 10 and an upper pin 20 from the lower cladding unit 10. It also has a pair of slots to accommodate the cladding units to be installed to the right of the array shown in the drawing. As seen in FIG. 2*c*, for each upper 24*a*, 24*b* and lower 24*c*, 24*d* pair of pins, the pin on the right side is at a different level from the pin on the left side. This arrangement allows for laterally adjacent cladding units to be attached to the same bracket which has four slots, one above the other without their pins colliding.

Figure 7:
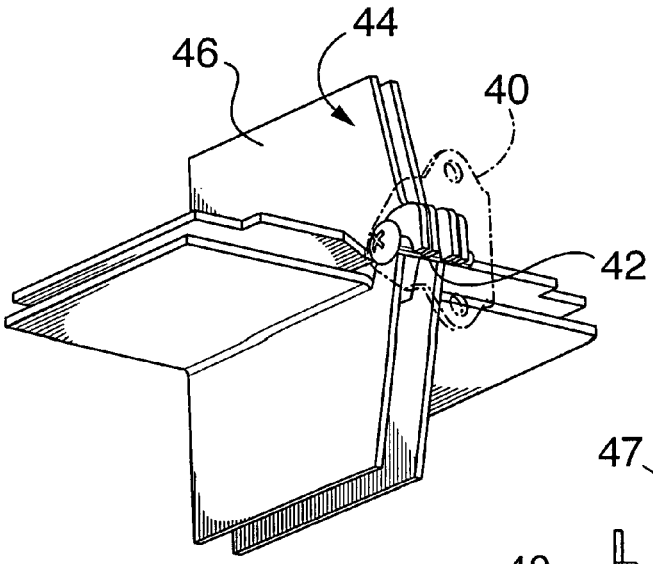
FIG. 7 shows an alternative attachment system.
Figure 8:
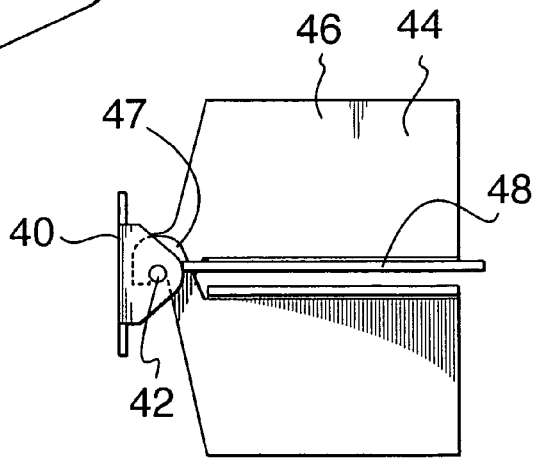
FIG. 8 is a side view of the alternative attachment system.
Figure 9:
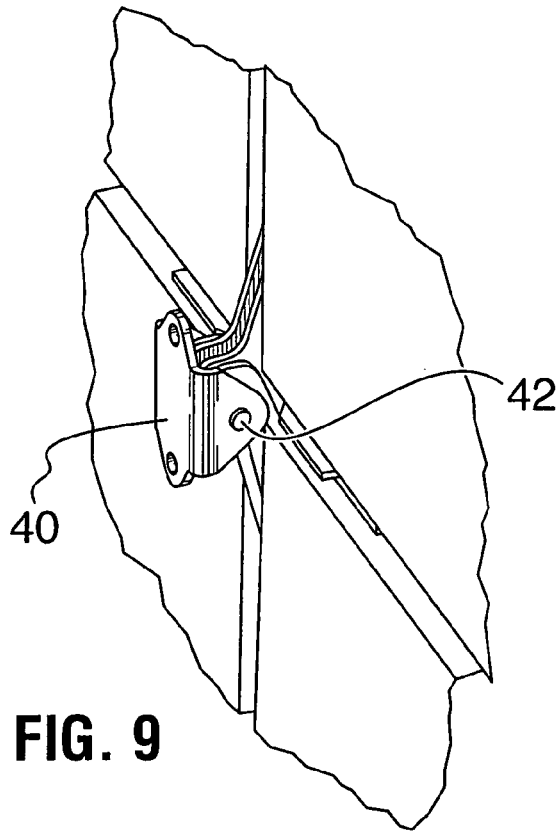
FIG. 9 is a view of the alternative attachment system from behind.
Figure 10:
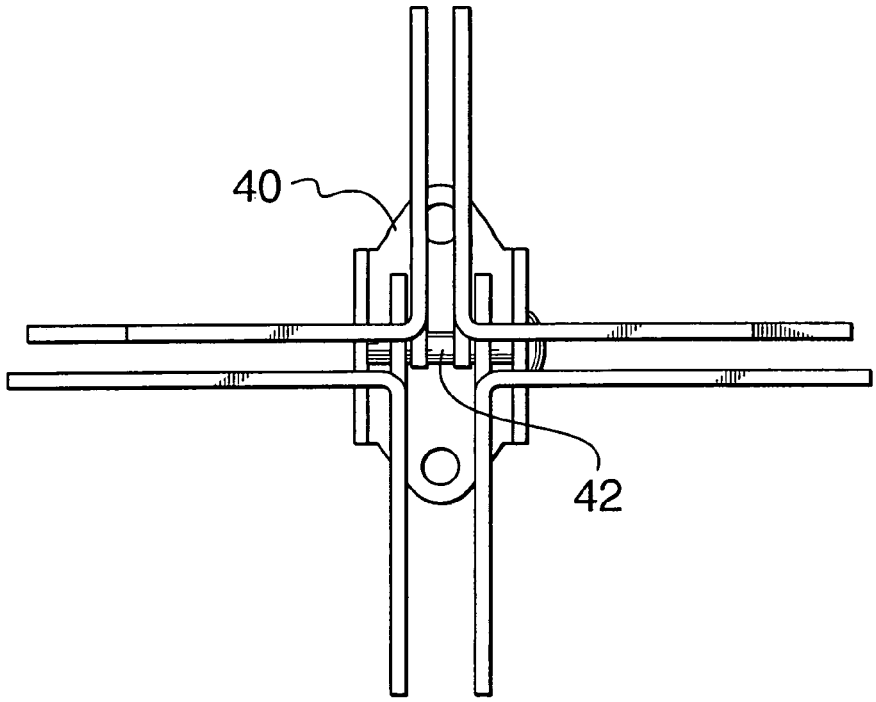
FIG. 10 is a skeletal view of the alternative attachment system from the front.

In an alternative embodiment, shown in FIGS. 7 to 10, the attachment system consists of a bracket 40 that is attached to a structural member of the building and provided with a single horizontal pin 42 facing toward the cladding units. A corner bracket 44 having right-angled plates 46, 48 is attached to each corner of the spacer frame of the cladding unit 10. The bracket 44 terminates in a hook 47, which hooks over the horizontal pin 42 of the bracket 40. As shown in FIG. 7, the hooks 46 from the brackets attached to the four adjacent cladding units lie side by side on the horizontal pin 42, which is attached to the building structure.

As shown in FIG. 6, a T-sectioned weathertight finishing strip 50 is inserted into the interstices or gaps between the adjacent cladding units. This can be in the form of an extruded elastomer gasket, or it can also be cure-in-place elastomer sealant, or a combination of the above.

In one embodiment formed metal section, which can be a roll-formed stainless or aluminum section, is placed over each structural member. This section has an adhesive foam strip mounted on the edge, which serves as a backer for silicone sealant that is applied after cladding units are installed. By sealing all joints as well, this section forms an air seal and drip gutter to allow the system to function according to 'rainscreen' principles. In the case of an overhead system, a deeper section should be used on rafters, and less deep section should be used on purlins, and sections should be tiled at purlin-rafter joints, so that any rainwater that penetrates the outer seal is wept away and down the rafter channels.

Stainless steel clips may be attached to structural members on top of air seal/drip gutter section via bolts.

As illustrated above the cladding units are installed by inserting pins in the front of clips and then sliding the entire unit downwards, in a 'hook and pin' arrangement. Bottom pins seat in the bottom of slots, and weight of the unit is transferred into the frame. Locking clips are installed to prevent the units from escaping via moving upward. Top pins are nominally positioned in the middle of the slot, so that upper pins can slide to take up differential expansion between glass, spacer, and structural members. Besides bearing weight of the units and locking this units in place, this 'hook and pin' clip system is capable of bearing significant wind loads, which act normal to the glass surface.

The pin system allows units to slide horizontally over a small distance relative to clips. This allows for differential expansion of components, as well as some small movement of structural members, without buildup of stress on the glass panels or spacers.

The hook and pin system allows relatively large deflection of structural members, by constraining only where necessary, and allowing freedom of movement everywhere else. The inherent structural value of the glass panel acts separately to prevent deflection of the glass edges beyond the L/175 value that is used in standard glass loading calculations.

EXAMPLE

Glazed cladding units were fabricated that consisted of translucent insulating glass units filled with SOLERA® honeycomb material and configured with 6 mm glass on each side, and 'S' style aluminum spacer frame at the periphery. Separation between lites of glass was 2.5" (63.5 mm), and combination of spacer, glass, and silicone adhesive provide sufficient structural capacity to span 48" (1200 mm) when only point-supported at four corners. Solera panels are manufactured by Advanced Glazings Ltd., Sydney NS Canada.

The glass can be coated with a UV curing acrylic adhesive resin, before creating the honeycomb sandwich. A suitable UV curing resin can be made from a combination of acrylic monomers and oligomers, with a UV-cure catalyst, and is supplied by UCB Chemicals Ltd., Smyrna, Ga. The panel is then cured by exposure to radiation from standard UV-B and UV-C fluorescent lamps through the glass. This honeycomb panel is very stiff and strong. Calculations show that a panel constructed in this manner of dimension 96"×48" is capable of supporting loads normal to its surface of up to 500 lbs per sq.ft., when simply supported at ends separated by the 96" dimension. This is far in excess of standard structural capabilities of monolithic glass lites, and thus, very large areas can be spanned with only corner support.

The above units are translucent and admit diffuse light. It is possible to make them fully transparent to provide full vision through them. In this case, the cladding units may consist of two layers of glass, preferably separated by a distance greater than the above 2.5"thickness with an aluminum S spacer frame, but without the honeycomb core. When using a gap larger than 1", as is necessary to get structural moment over large distances, the pressure in the cavity between the glass is equalized by venting to the outdoors in a controlled manner, such as by the use of a 0.020" ID (inner diameter)×12" long stainless steel tube (not shown) commonly used in the glass industry for that purpose. When using clear vision units, venting should be done through a desiccant cartridge to prevent buildup of humidity and resultant internal condensation within the cladding unit.

Clear vision units with a spacing between lites in the conventional range of 0.5" to 1" can be utilized in this system, provided that the spacer extends beyond the glass in one or more directions, forming an 'integrated spacer frame' unit. Additionally, a standard sealed insulated glass unit can be glazed in a metal or polymer frame that provides the structural capability and compatibility with the clip system.

Thus it will be seen that the glazed cladding units in accordance with embodiments of the invention have inherent structural capacity, such that they can be secured against windload and deadload at 3 or more points only. The structural capacity is provided by increased spacing between lites, structural moment provided by the spacer, bonding of glass to a translucent insert in the space between the glass, and any combination of the above. The attachment system allow the structural cladding units to be attached directly to structural members, such that the panels are secured against windload and deadloads, but with sufficient freedom of movement to accommodate differential thermal expansion, load-induced movements, and structural movements of the building structure itself without applying damaging stress to the glazing panels.

The weathertight finish covers the exterior of the spaces between units. The drip gutter system that is placed between the supporting structural members and the glass cladding units catches and weeps away any rainwater that may work its way past the outer seals, and forms an inner seal as per the rain screen principle.

I claim:

1. A point-supported cladding system for finishing the exterior of a building, comprising:

a plurality of like rigid box-like glazed cladding units;

each cladding unit comprising:

a rigid spacer frame bounding said cladding unit;

a pair of parallel light-transmissive glass lites having a thickness of not more than about 9 mm mounted at their periphery on said rigid spacer frame by means of a resilient seal;

horizontally protruding pins adjacent each corner of said cladding unit and arranged as upper and lower pairs of pins, the pins of each of said upper and lower pairs being arranged on the right and left sides of the cladding unit, respectively, the upper pair of pins being separated by a first vertical distance and the lower pair of pins being separated by a second vertical distance; and said cladding unit being dimensioned and configured to have sufficient rigidity to maintain its structural integrity when supported only by said pins; and a plurality of brackets for mounting on structural members of said building adjacent to corners of each cladding unit;

each said bracket comprising a protruding plate with an outer vertical edge, and lateral portions for attachment to said structural members;

each said plate having a series of angled slots formed therein arranged in a single line one above the other . . . is equal to the second vertical distance; and wherein the upper pair of slots are adapted to receive the lower pin from each adjacent upper panel, and wherein the lower pair of slots are adapted to receive the upper pin from each adjacent lower panel; each said slot having a laterally extending portion terminating in an opening in said outer vertical edge, and a vertical portion with a blind lower end, said vertical portion merging at an upper end with an inner end of said lateral portion;

whereby installation of said cladding units is achieved by engaging said pins with corresponding said openings, displacing said cladding units laterally into said slots until said pins reach the vertical portions thereof, whereupon said pins drop into said vertical portions to retain said cladding units in a contiguous array on said building and thereby provide an exterior wall of said building, said pins and brackets bearing the load of said cladding units and locking said cladding units against movement in a direction normal to said wall while permitting limited freedom of movement of said cladding units relative to each other and said building in a plane parallel to said wall, and whereby said arrangement of pins and slots permits said cladding units to be mounted in a contiguous fashion on said wall by said brackets.

2. A point-supported cladding system as claimed in claim 1, wherein said pins have an enlarged head to assist in their retention in said slots.

3. A point-supported cladding system as claimed in claim 2, wherein said enlarged head allows lateral play in said slots.

4. A point-supported cladding system as claimed in claim 1, wherein said structural integrity is ensured by said lites having a separation that is greater than a predetermined minimum value dependent on the size of said cladding units.

5. A point-supported cladding system as claimed in claim 4, wherein said separation is at least 2.5" and said cladding units are about 48" square.

6. A point-supported cladding system as claimed in claim 4, wherein said lites are transparent.

7. A point-supported cladding system as claimed in claim 6, further comprising a desiccant in said conduit to prevent build-up of humidity in the interior of said cladding units.

8. A point-supported cladding system as claimed in claim 1, wherein said structural integrity is ensured by a translucent insert provided between said lites.

9. A point-supported cladding system as claimed in claim 8, wherein said translucent insert is a plastic honeycomb insert.

10. A point-supported cladding system as claimed in claim 9, wherein said lites are coated with an acrylic adhesive resin securing said lites to said honeycomb insert.

11. A point-supported cladding system as claimed in claim 1, wherein said seal is made of glazing silicone.

12. A point-supported cladding system as claimed in claim 1, further comprising a weather-tight finishing material for insertion into interstices between adjacent said cladding units of said contiguous array.

13. An assembled cladding structure mounted on the exterior of a building, comprising:

a plurality of contiguous rigid box-like glazed cladding units;

each cladding unit comprising:

a rigid spacer frame bounding said cladding unit;

a pair of parallel light-transmissive glass lites having a thickness of not more than about 9 mm mounted at their periphery on said rigid spacer frame by means of a resilient seal;

horizontally protruding pins adjacent each corner of said cladding unit and arranged as upper and lower pairs of pins, the pins of each of said upper and lower pairs of pins being arranged on the right and left sides of the cladding unit, respectively, the upper pair of pins being separated by a first vertical distance and the lower pair of pins being separated by a second vertical distance; and said cladding unit being dimensioned and configured to have sufficient rigidity to maintain its structural integrity when supported only by said pins; and a plurality of brackets for mounting on structural members of said building adjacent to corners of each cladding unit;

each said bracket comprising a protruding plate with an outer vertical edge, and lateral portions for attachment to said structural members;

each said plate having a series of angled slots formed therein arranged in a single line one above the other . . . is equal to the second vertical distance; and wherein the upper pair of slots are adapted to receive the lower pin from each adjacent upper panel, and wherein the lower pair of slots are adapted to receive the upper pin from each adjacent lower panel; each said slot having a laterally extending portion terminating in an opening in said outer vertical edge, and a vertical portion with a blind lower end, said vertical portion merging at an upper end with an inner end of said lateral portion; and wherein said pins are located in said vertical portions to retain said cladding units in a contiguous array on said building and thereby provide an exterior wall of said building, said pins and brackets bearing the load of said cladding units and locking said cladding units against movement in a direction normal to said wall while permitting limited freedom of movement of said cladding units relative to each other and said building in a plane parallel to said wall.

14. A point-supported cladding system as claimed in claim 13, further comprising a drip gutter for mounting on said structural members behind said cladding units to catch any rainwater that works its way behind the weather tight finishing material, thereby implementing rainscreen principals.

* * * * *